US006196426B1

(12) United States Patent
White

(10) Patent No.: US 6,196,426 B1
(45) Date of Patent: Mar. 6, 2001

(54) REVERSIBLE PILL COUNTING DEVICE

(76) Inventor: Renee S. White, 2034 E. Wahalla La., Phoenix, AZ (US) 85024

( * ) Notice: Subject to any disclaimer, the term of this patent is extended or adjusted under 35 U.S.C. 154(b) by 0 days.

(21) Appl. No.: 09/503,132

(22) Filed: Feb. 11, 2000

(51) Int. Cl.[7] ..... B65B 3/06
(52) U.S. Cl. ..... 222/572; 222/462; 414/675
(58) Field of Search ..... 222/129, 158, 222/462, 572; 141/370; 414/675

(56) References Cited

U.S. PATENT DOCUMENTS

| | | | |
|---|---|---|---|
| 2,530,009 | | 11/1950 | Fields . |
| 2,536,127 | | 1/1951 | De Philip . |
| 3,150,785 | | 9/1964 | Clasen . |
| 3,255,894 | | 6/1966 | Van Handel et al. . |
| 3,819,064 | * | 6/1974 | Chandler ..... 414/675 |
| 3,848,395 | | 11/1974 | Totten . |
| 4,063,645 | | 12/1977 | Canterman et al. . |
| 4,065,000 | | 12/1977 | Murton . |
| 4,261,683 | | 4/1981 | Zaleon . |
| 4,643,316 | | 2/1987 | Hoffmann . |
| 5,433,256 | | 7/1995 | Vasers . |

* cited by examiner

*Primary Examiner*—Janice L. Krizek
(74) *Attorney, Agent, or Firm*—Frank J. McGue

(57) ABSTRACT

A pill counting device is disclosed which comprises a tray having two pouring spouts 42 positioned at adjacent corners thereof. A receptacle is positioned along a side of the tray opposite the two pouring spouts. The receptacle comprises a bin extending downwardly from the surface of the tray and a cover for the bin. The cover is movable between an open position and a closed position, the closed position forming the receptacle. The receptacle is open at both ends thereof which correspond to the corners of the tray not occupied by the pouring spouts. The open receptacle ends can be closed as desired.

13 Claims, 1 Drawing Sheet

REVERSIBLE PILL COUNTING DEVICE

TECHNICAL FIELD

This invention relates to pill counting devices, and, more particularly, to a reversible pill counting device which is equally useable by both left and right handed pharmacists.

BACKGROUND OF THE INVENTION

Present day pharmacists generally use pill counting devices which allow a pharmacist, when filling a prescription for a specified number of pills, to pour uncounted pills from a bulk container onto a tray having a collecting bin positioned along one side margin thereof and a spout on the opposite side thereof. The term "pills" as used herein refers to both tablets and capsules. The specified number of pills is pushed into the bin, typically by a spatula. The bin is closed and the overage pills remaining on the tray are returned to the bulk container via a spout. The specified number of pills are poured from the bin via an opening at one end of the bin to an appropriate container via an opening in the bin.

However, the present devices are generally not bilaterally symmetric and are generally provided in a configuration most suitable for right handed individuals, who, of course, make up the majority of pharmacists as in the general population. While it would be a relatively trivial change to manufacture a left handed configuration of the basic device, simply manufacturing a left handed configuration requires the purchase of two trays, one left handed and one right handed, for use by a pharmacy staffed with both left and right handed individuals. Thus, there is a need for a pill counting tray which is reversible for ease of use by both right and left handed individuals.

Various types of pill counting trays have been described in the patent literature.

U.S. Pat. No. 2,530,009 entitled "Tablet Counting Device" which issued on Nov. 15, 1950 to Fields discloses the pill counting device described above. The counting device dispenses tablets through a cylindrical member 4 which has a hinged cover 12 and a pouring spout 15. Another spout 17 allows for removal of excess tablets not counted to a bulk container.

U.S. Pat. No. 3,255,894 entitled "Pill and Capsule Counting Tray and Finger Spatula" which issued on Jun. 14, 1966 to Van Handel et al. discloses a pill counting tray having means to pour pills through opening 26 or oppositely through opening 24.

U.S. Pat. No. 4,063,645 entitled "Sorting Tray" which issued on Dec. 1\20, 1977 to Canterman et al. discloses a sorting tray which has a plug 34 which prevents discharge from chamber 28.

U.S. Pat. No. 4,261,683 entitled "Pill Counting Tray" which issued on Apr. 14, 1981 to Zaleon discloses a pill counting tray in which pills may be removed through a pair of oppositely facing pouring spouts 40.

None of the known prior art disclose the device set forth herein.

SUMMARY OF THE INVENTION

It is an object of this invention to provide an improved pill counting device suitable for use by both right and left handed pharmacists.

Further objects and advantages of the invention will become apparent as the following description proceeds and the features of novelty which characterize this invention will be pointed out with particularity in the claims annexed to and forming a part of this specification.

BRIEF DESCRIPTION OF THE DRAWINGS

The present invention may be more readily described by reference to the accompanying drawings in which.

DESCRIPTION OF THE PREFERRED EMBODIMENT

Figure 1:
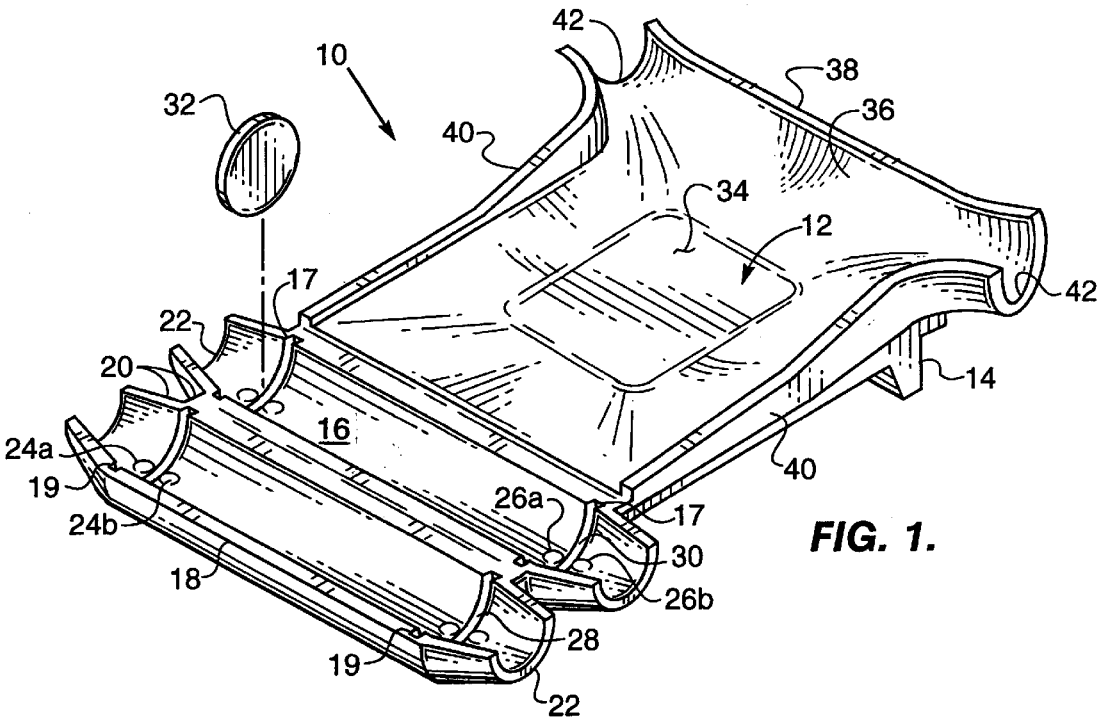
FIG. 1 is a perspective view of the present invention attached.
Figure 2:
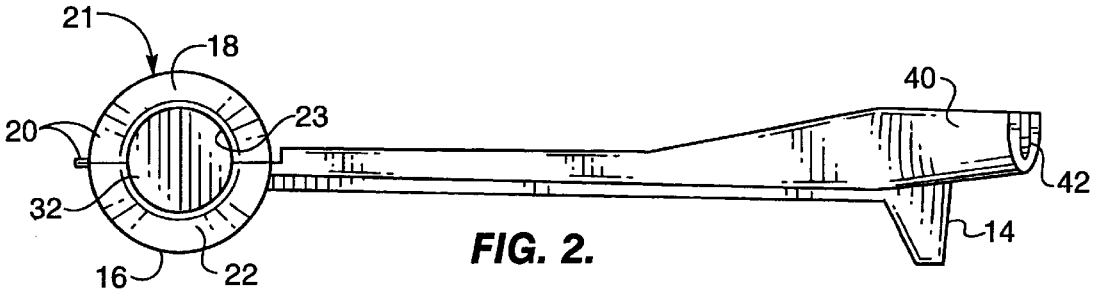
FIG. 2 is a side view of the present invention.

Referring more particularly to the drawings by characters of reference, FIGS. 1–2 disclose a pill counting device 10 comprising a tray 12 which has two pouring spouts 42 positioned at adjacent corners thereof. A receptacle 21 is positioned along a side of tray 12 opposite the two pouring spouts 42. In general, receptacle 21 comprises a bin 16 extending downwardly from the surface of tray 12 and a cover 18 for bin 16, cover 18 being movable between an open position and a closed position. Receptacle 21 has openings 23 at both ends thereof which correspond to the corners of tray 12 not occupied by pouring spouts 42. Device 10 includes means 32 for closing one or the other of the receptacle ends as desired.

In the preferred embodiment, device 10 comprises a rectangular tray 12 which is supported on a surface by suitable legs or feet 14 at one end thereof, the other end being supported by semi-cylindrical bin 16 formed integrally along one side of tray 12.

Attached to bin 16 is cover 18 which is hinged to bin 16 opposite tray 12, preferably by a living hinge 20. When cover 18 is rotated as shown by the arrow in FIG. 2 from an open position shown in FIG. 1 to a closed position shown in FIG. 2, cover 18 and bin 16 cooperate to form more or less cylindrical receptacle 21. To hold cover 18 and bin 16 together, lugs 17 on bin 16 snap into slots 19 on cover 18. Other means for releasably holding cover 18 and bin 16 together will be apparent to those skilled in the art.

Each end of the cylindrical receptacle forming cover 18 and bin 16 are provided with tapered spout forming sections 20 and 22, respectively, which cooperate to form reduced diameter spout 23 through which pills can be poured from cylindrical receptacle 21 into a suitable container.

On the interior of each of the cylindrical receptacle forming cover 18 and bin 16 proximate to tapered spout forming sections 20 and 22 are a pair of ridges 24*a* and 24*b* and 26*a* and 26*b*, respectively, which define channels 28 and 30 therebetween. When cover 18 is rotated as shown by the arrow in FIG. 2 to a closed position shown therein, channels 28 and 30 cooperate to form more or less continuous circular channels at each end of the cylindrical receptacle. The periphery of closing means or disk 32 is releasably received and retained within the circular channel when cover 18 and bin 16 are in the closed position.

Disk 32 closes the reduced diameter spout 23 located at the end of said cylindrical receptacle thus leaving the other reduced diameter spout 23 open. The ability to close one or the other end allows a user to use in a right handed or a left handed mode as desired. The position shown in FIG. 1 is the right handed mode. Placement of disk 32 at the other end reverses the device for use by left handed individuals.

Those skilled in the art will recognize that other means of retaining disk 32 within the cylindrical receptacle are possible. For example, instead of continuous ridges 24 and 26, one or more pairs of bumps aligned along a circle defined by the interior periphery of cover 18 and bin 16 could be employed to receive the periphery of disk 32 therebetween.

Tray 12 includes a flat middle portion 34 which is surrounded by a sloped portion 36. In the presently preferred embodiment, sloped portion 36 is at a 7 degree angle sloping upwardly and away from middle portion 34. At the end of tray 12 opposite bin 16 is an upstanding flange 38, which, in the presently preferred embodiment, is about ¼ inch high. On each side of tray 12 between flange 38 and bin 16 are side flanges 40, preferably about 2 centimeters high. Side flanges 40 and upstanding flange 38 have adjacent ends curving outwardly, as shown in FIG. 1, to provide the pouring spouts 42, sloping portion 36 being suitably extended to form the bottom of each spout 42.

To use, the pharmacist first elects whether to employ the right handed configuration by placing chip 32 as shown in FIG. 1 or the left handed configuration which places chip 32 in channels 28 and 30 positioned at the other end of cylindrical receptacle 21, i.e. a mirror image of FIG. 1. Device 10 is placed flat on a surface with cover 18 in an open position as shown in FIG. 1 (or its mirror image).

The pharmacist pours an unmeasured quantity of pills from a bulk container (not shown) onto tray 12. Sloped portion 36 and flat middle portion 34 cooperate to position the unmeasured quantity of pills within tray 12. The pharmacist using a suitable instrument, typically a spatula, the required number of pills is separated from the unmeasured quantity and moved across tray 12 into bin 16. For a right handed pharmacist, the movement is from left to right as shown in FIG. 1; for a left handed pharmacist, the movement is from right to left.

When the required number has been deposited in bin 16, cover 18 is closed over bin 16 thereby forming cylindrical receptacle 21. Any remaining oversupply of pills left within tray 12 is poured through the spout 42 which is diagonally opposite the open diameter spout 23 back into the bulk container. Use of that particular spout 42 is done without losing any pills from cylindrical receptacle 21 since disk 32 prevents any loss from the closed diameter spout 23. Device 10 is then inverted to pour the pills from cylindrical receptacle 21 into a suitable container for dispensing to the patient.

The material from which the device is made may be plastic, metal or other material.

Although only certain embodiments have been illustrated and described, it will be apparent to those skilled in the art that various changes and modifications may be made therein without departing from the spirit of the invention or from the scope of the appended claims.

What is claimed is:

1. A pill counting device for use by left handed and right handed individuals comprises:

a tray having two pouring spouts positioned at adjacent corners of the tray, a receptacle positioned along a side of the tray opposite the two pouring spouts, the receptacle comprising a bin extending downwardly from the surface of the tray and a cover for the bin, the cover being movable between an open position and a closed position, the receptacle having openings at both ends thereof corresponding to the corners of the tray not occupied by pouring spouts, and means for closing one or the other of the receptacle openings as desired.

2. The device of claim 1 further including legs mounted under the tray for supporting the device on a surface.

3. The device of claim 1 wherein the cover is hinged to the bin.

4. The device of claim 1 wherein the receptacle is cylindrically shaped, the bin and the cover being semi cylindrical shapes.

5. The device of claim 4 wherein the openings are formed at each end of the cover and the bin, each end of the cover and the bin being provided with tapered spout forming sections which cooperate to form a reduced diameter spout when the cover is in the closed position.

6. The device of claim 5 wherein the closing means comprises:

a pair of ridges positioned on the interior of each of the cover and the bin proximate to the tapered spout forming sections, the pair of ridges defining channels, the channels on the cover and the bin cooperating to form circular channels at each end of the receptacle, and a disk having a periphery which is releasably received and retained within one of the circular channels when the cover is in the closed position.

7. The device of claim 1 wherein the tray includes a flat middle portion surrounded by a sloped portion.

8. The device of claim 7 wherein the sloped portion is at a 7 degree angle sloping upwardly and away from the flat middle portion.

9. The device of claim 8 wherein the end of the tray opposite the receptacle has an upstanding flange.

10. The device of claim 9 wherein the tray further comprises side flanges mounted on each side of the tray between the upstanding flange and the bin, the side flanges and the upstanding flange having adjacent ends curving outwardly to provide the pouring spouts, the sloped portion being suitably extended to form the bottom of the pouring spouts.

11. A pill counting device for use by left handed and right handed individuals comprises:

a tray having two pouring spouts positioned at adjacent corners of the tray, the tray further having legs mounted thereunder for supporting the tray on a surface, a cylindrical receptacle positioned along a side of the tray opposite the two pouring spouts, the receptacle comprising a semi-cylindrical bin extending downwardly from the surface of the tray and a semi-cylindrical cover for the bin, the cover being hinged to the bin, the cover being movable between an open position and a closed position, the receptacle having a spout at both ends thereof corresponding to the corners of the tray not occupied by pouring spouts, the spouts being formed at each end of the cover and the bin, each end of the cover and the bin being provided with tapered spout forming sections which cooperate to form the spouts when the cover is in the closed position, a pair of ridges positioned on the interior of each of the cover and the bin proximate to the tapered spout forming sections, the pair of ridges defining channels, the channels on the cover and the bin cooperating to form circular channels at each end of the receptacle, and a disk having a periphery which is releasably received and retained within one of the circular channels when the cover is in the closed position.

12. The device of claim 11 wherein the tray includes a flat middle portion surrounded by a sloped portion, the sloped portion being at a 7 degree angle sloping upwardly and away from the flat middle portion.

13. The device of claim 12 wherein the end of the tray opposite the receptacle has an upstanding flange and two side flanges mounted on each side of the tray between the upstanding flange and the bin, the side flanges and the upstanding flange having adjacent ends curving outwardly to provide the pouring spouts, the sloped portion being suitably extended to form the bottom of the pouring spouts.

* * * * *